US006588840B1

(12) United States Patent
Lombardo

(10) Patent No.: US 6,588,840 B1
(45) Date of Patent: Jul. 8, 2003

(54) SEAT CUSHION FOR STADIUM SEATS

(76) Inventor: Catherine Alberta Lombardo, 37548 Sturbridge La., Willoughby, OH (US) 44094

( * ) Notice: Subject to any disclaimer, the term of this patent is extended or adjusted under 35 U.S.C. 154(b) by 238 days.

(21) Appl. No.: 09/660,160

(22) Filed: Sep. 12, 2000

(51) Int. Cl.[7] ..... A47C 31/00

(52) U.S. Cl. ..... 297/228.12; 297/219.1; 297/4; 297/188.08; 297/228.01; 5/653

(58) Field of Search ..... 297/228.1, 252, 297/219.1, 217.7, 4, 188.01, 188.08, 220, 228.12, 218.2; 5/653

(56) References Cited

U.S. PATENT DOCUMENTS

| | | | | | |
|---|---|---|---|---|---|
| 4,190,918 | A | | 3/1980 | Harvell | |
| 4,466,517 | A | | 8/1984 | Spiegelman | |
| 4,597,605 | A | | 7/1986 | Gilbert | |
| 4,604,987 | A | * | 8/1986 | Keltner | 126/204 |
| 4,654,907 | A | | 4/1987 | Haugaard | |
| 4,783,120 | A | * | 11/1988 | Kiechlin | 297/230 |
| 4,799,731 | A | * | 1/1989 | Brown | 297/192 |
| 4,854,637 | A | * | 8/1989 | McCree | 291/188 |
| 5,516,193 | A | * | 5/1996 | Simpson | 297/252 |
| 6,202,235 | B1 | * | 3/2001 | Salhanick | 5/653 |

* cited by examiner

*Primary Examiner*—Carl D. Friedman
*Assistant Examiner*—Jennifer I. Thissell
(74) *Attorney, Agent, or Firm*—Eugene E. Clair

(57) ABSTRACT

A seat cushion cover (20) in combination with a sport seat cushion (22) includes a rectangular pocket (24) defined by a fabric upper panel (26) and a lower panel (28). The upper and lower panels (26, 28) are generally parallel to one another and are joined by side panels (30*a,b*) and an end panel (32). A fabric flap (34) extends from the upper panel (26). The flap (34) is adapted to retain the cushion (22) within the pocket (24) and provide for securing the cushion (22) on a stadium seat (54). The flap (34) foldably extends over an opening (33) of the pocket (24) and along a portion of lower panel (28). The flap (34) and the portion of the lower panel (28) are separated by a space for receiving the stadium seat bottom (56). The flap (34) is adjustably secured to the side panels (30*a,b*) with fasteners (42, 44, 46, 48, 50, 52). A resilient band (36) provides tension to retain the cover (20) on the seat bottom (56) when it is in its raised position.

11 Claims, 2 Drawing Sheets

SEAT CUSHION FOR STADIUM SEATS

BACKGROUND OF THE INVENTION

The present invention relates to portable seat cushions for sports stadium seats and is particularly related to as removable cover for portable seat cushions. The present invention finds particular application in conjunction with stadium seating in which the seat automatically raises into an up position when the seat occupant stands and will be described with particular respect thereto.

Portable cushions are commonly used by spectators to sporting events to provide additional comfort when seated on wooden seats. In many sports stadiums, the seats automatically rise when the spectator stands up. A portable seat cushion placed on an automatically rising seat generally falls between the seat bottom portion and seat back to the concrete floor in the stadium when the spectator stands up.

Thus, it is desirable to provide a cushion apparatus for automatically raising seats that does not suffer from the deficiencies above and can be used with existing sports cushions.

SUMMARY OF THE INVENTION

The present invention is directed to a sports cushion cover that satisfies the need to provide a sports cushion which can retain a sport cushion on an automatically rising sport stadium seat. An apparatus in accordance with one embodiment of the present invention includes a seat cushion cover in combination with a sport seat cushion. The cover comprises a flexible fabric pocket for receiving a sport seat cushion. The fabric pocket has an opening, an upper panel and a lower panel. The upper and lower panels are joined by side panels and an end panel. In addition, the upper panel includes a transparent flexible fabric portion that provides for viewing of a team logo on the cushion contained within the cover.

The cover includes a resilient fabric flap extending from the upper panel. The flap is adapted to retain the cushion within the pocket and provide for securing the cushion on an automatically rising stadium seat bottom. The flap foldably extends over the opening of the pocket and along a portion of lower panel. The flap and the portion of the lower panel are separated by a space which receives the bottom of the stadium seat. Hook and loop fasteners are attached to the side panels and to the flap. The hook and loop fasteners adjustably secure the flap to the side panels. Alternatively, a plurality of fabric ties replaces the hook and loop fasteners.

One advantage of the present invention is that the sport cushion is securely retained on the stadium seat when the spectator stands and the seat automatically rises. Another advantage of the present invention is that it can be used with a seat cushion that is presently owned by a spectator. Yet a further advantage of the present invention is that the logo of the presently owned seat cushion is viewable through the cover.

The present invention provides the foregoing and other features hereinafter described and particularly pointed out in the claims. The following description and accompanying drawings set forth certain illustrative embodiments of the invention. It is to be appreciated that different embodiments of the invention may take form in various components and arrangements of components. These described embodiments being indicative of but a few of the various ways in which the principles of the invention may be employed. The drawings are only for the purpose of illustrating a preferred embodiment and are not to be construed as limiting the invention.

BRIEF DESCRIPTION OF THE DRAWINGS

The foregoing and other features and advantages of the present invention will become apparent to those skilled in the art to which the present invention relates upon consideration of e following detailed description of a preferred embodiment of the invention with reference to the accompanying drawings, wherein.

DETAILED DESCRIPTION

Figure 1:
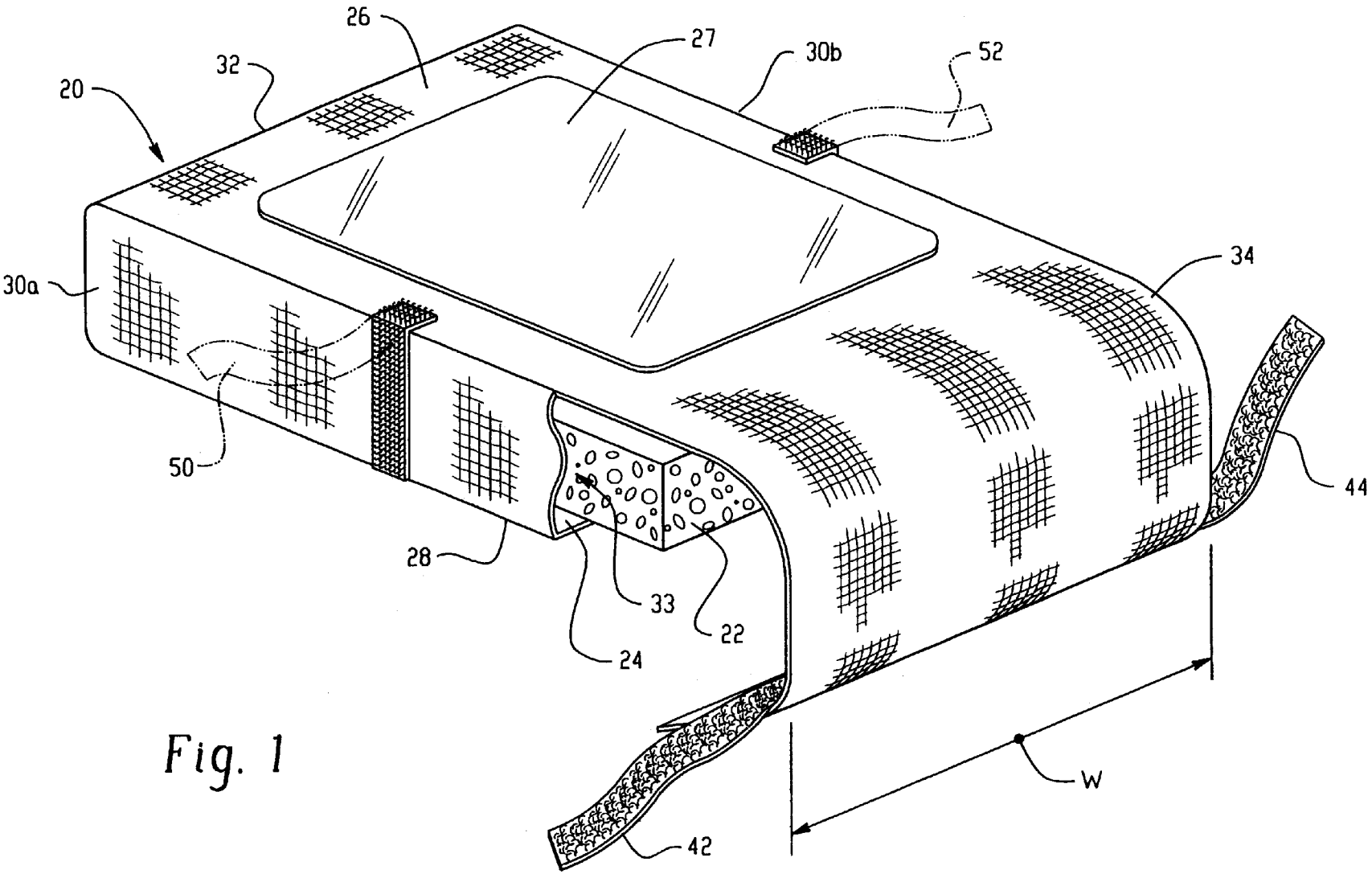
FIG. 1 is a top perspective view of a sport cushion cover in accord with features of an embodiment of the present invention.

With reference to FIG. 1, a seat cushion cover 20 receives a sport seat cushion 22. The cover 20 includes a pocket 24 defined by a flexible fabric for receiving the sport seat cushion 22. The pocket 24 is defined by an upper panel 26 and a lower panel 28. The upper panel 26 includes a transparent flexible fabric portion 27 that provides for viewing of a team logo on the cushion 22 contained therein. The transparent flexible fabric portion 27 is preferably a mesh fabric, however, a clear plastic material may be used. The upper and lower panels 26, 28 are joined by side panels 30*a*, 30*b* and an end panel 32. The side panels 30*a,b* and end panel 32 may be made of a single piece of fabric that extends around and is attached to the perimeter of the upper 26 and lower 28 panels. Alternatively, the upper and lower panels 26, 28 may be a single piece of fabric folded to form a common end portion and attached to each other along their edges to form the sides of the pocket 24. An opening 33 for receiving the cushion 22 into the pocket 24 is opposite the end panel 32.

Figure 3:
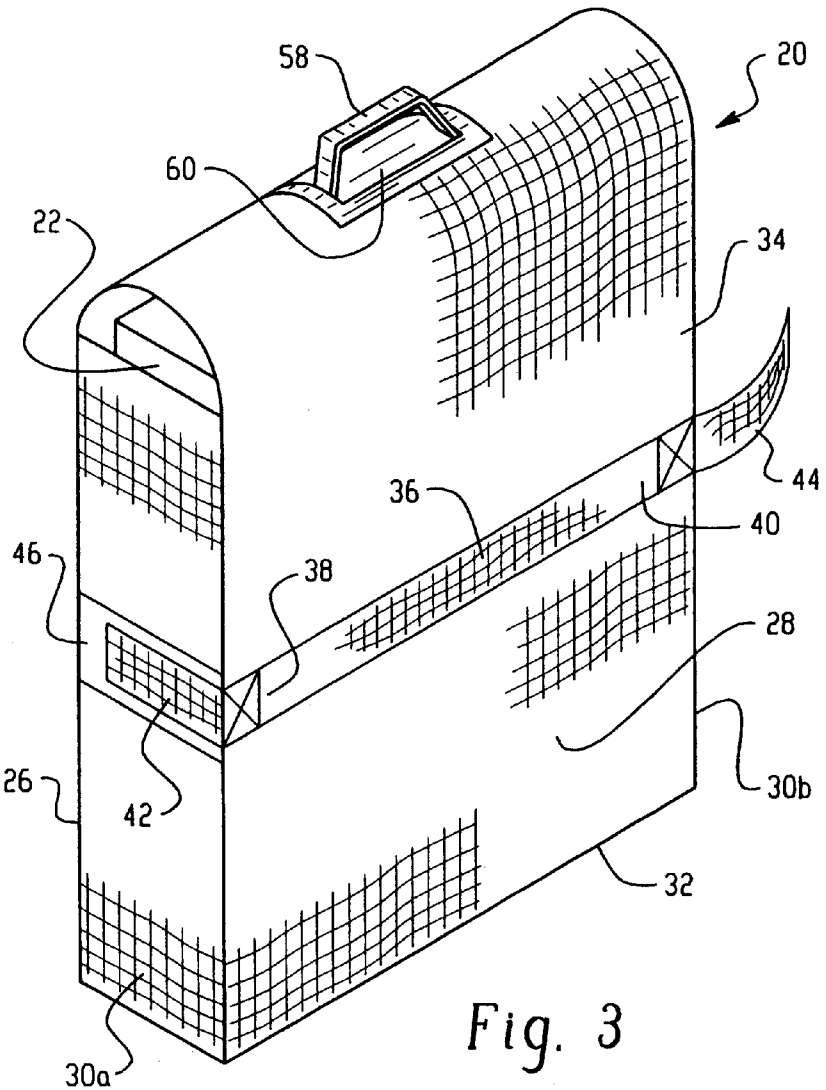
FIG. 3 is a perspective view of a sport cushion cover in accord with features of another embodiment of the present invention.

A fabric flap 34 extends from the upper panel 26 at the opening 33. The flap 34 has a width W. Referring briefly to FIG. 3, preferably the flap 34 includes a resilient fabric band 36 which is suitably attached to the flap 34 to provide for a resilient or elastic capability across the width W of the flap 34. Alternatively, the entire flap 34 extending from the opening end of the upper panel 26 comprises a resilient fabric panel, such as lycra or another elastic type of material.

The band 36 has a first end 38 and a second end 40. A hook fastener 42 is attached to the first end 38 and second hook fastener 44 is attached to the second end 40. A loop fastener 46 is attached to the side panel 30*a* and a loop fastener 48 is attached to the side panel 30*b*. Alternatively, the hook fasteners 46, 48 can be replaced by fabric ties attached to the ends 38, 40. In this embodiment, a fabric tie 50 is attached to the side 30*a* and a fabric tie 52 is attached to the side 30*b*. The ties 50, 52 are tied together with respective fabric ties that replace the fasteners 42, 44 at the ends 38, 40.

Figure 2:
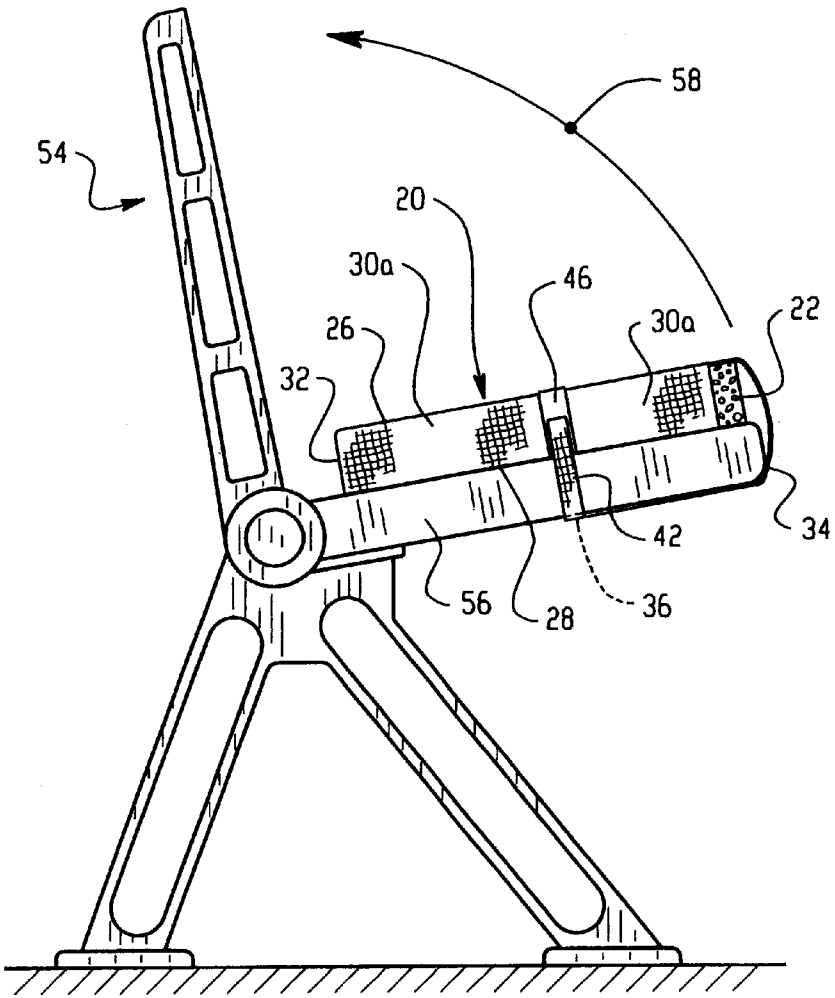
FIG. 2 is a side perspective view of a sport cover cushion of FIG. 1. used in combination with an automatically rising stadium seat.

Referring to FIG. 2, the seat cushion cover 20 is shown in use on a stadium seat 54. The cover 20 is shown secured to a seat bottom 56 which moves in the direction of an arrow 58 into a raised position. The seat bottom 56 may be one that is manually raised by the occupant or may be of the type that rises automatically when the occupant stands. The flap 34 is adapted to retain the cushion 22 within the pocket 24 by folding over the opening 33. The cushion 22 and cover 20 are secured to the seat bottom 56 by the flap 34. The flap 34 is secured to the side panel 30*a* by the hook 42, 44 and loop 46, 48 fasteners. Alternately, the fabric ties 50, 52 can be tied to secure the flap 34 to the sides 30*a,b*. The seat bottom 56 is received in a space between the lower panel 28 and the flap 34. The resilient fabric band 36 supplies the necessary resilience to securely retain the cover 20 on the seat bottom 56 when in the raised position. If the entire flap 34 is made of a resilient panel, the flap 34 provides the desired tension across the width W of the flap 34 to secure the cover 20 to the seat bottom 56.

Referring again to FIG. 3, the cushion 22 includes a handle 58 which is threaded through an opening 60 in the flap 34, providing for convenient carrying of the cover 20 and cushion 22. Alternatively, a handle may be attached directly to the flap.

While a particular feature of the invention may have been described above with respect to only one of the illustrated embodiments, such features may be combined with one or more other features of other embodiments, as may be desired and advantageous for any given particular application.

From the above description of the invention, those skilled in the art will perceive improvements, changes and modification. Such improvements, changes and modification within the skill of the art are intended to be covered by the appended claims.

What is claimed is:

1. A seat cushion cover in combination with a sport seat cushion, the cover comprising:

a rectangular pocket adapted for receiving a cushion, the pocket defined by a fabric upper panel and a lower panel, the upper and lower panels generally parallel to one another and joined by side panels and an end panel, the pocket having an opening opposite the end panel;

a fabric flap extending from the upper panel, the flap adapted to retain the cushion within the pocket and provide for securing the cushion on a stadium seat, the flap foldably extending over the opening of the pocket and along a portion of lower panel, the flap and the portion of the lower panel separated by a space for receiving the stadium seat; and securing means attached to the side panels and to the flap, the securing means for adjustably securing the flap to the side panels.

2. The seat cushion cover of claim 1 wherein the flap has a width and includes a resilient fabric band across the width, the band having a first end and a second end.

3. The seat cushion cover of claim 2 wherein the securing means on the flap is attached to each of the first end and the second end of the fabric band.

4. The seat cushion cover of claim 1 wherein the flap extending from the upper panel comprises a resilient fabric panel.

5. The seat cushion cover of claim 1 including a transparent flexible fabric portion in the upper panel providing for viewing of a team logo on the cushion contained therein.

6. The seat cushion cover of claim 5 wherein the transparent flexible fabric portion is a mesh fabric.

7. The seat cushion cover of claim 1 wherein the securing means are a plurality of fabric ties.

8. The seat cushion cover of claim 1 wherein the securing means are hook and loop fasteners.

9. The seat cushion cover of claim 1 including an opening in the fabric flap wherein a handle on the sport cushion is accessible through the opening.

10. A seat cushion cover in combination with a sport seat cushion, the cover comprising:

a rectangular pocket defined by a fabric upper panel and a lower panel, the upper and lower panels generally parallel to one another and joined by side panels and an end panel, the pocket having an opening opposite the end panel for receiving an associated cushion, the upper panel including a transparent flexible fabric portion providing for viewing of a team logo on the cushion contained therein;

a resilient fabric flap extending from the upper panel, the flap adapted to retain the cushion within the pocket and provide for retaining the cushion on a stadium seat by foldably extending over the opening of the pocket and along a portion of lower panel, the flap and the portion of the lower panel separated by a space for receiving the sport seat; and hook and loop fasteners attached to the side panels and to the flap, the hook and loop fasteners for adjustably securing the flap to the side panels.

11. A seat cushion cover in combination with a sport seat cushion, the cover consisting of:

an upper fabric panel and a lower fabric panel, the upper and lower panels having side edges and a common edge, the upper and lower panels folded adjacent to one another at the common edge and joined at the side edges to define a pocket, the pocket having an opening for receiving a cushion;

a fabric flap extends from the upper panel, the flap having two opposite edge portions, the flap adapted to retain the cushion within the pocket and provide for retaining the cushion on a stadium seat by foldably extending over the opening of the pocket and along a portion of lower panel, the flap and the portion of the lower panel separated by a space for receiving the stadium seat; and a plurality of fabric ties respectively attached to each of the side edges and to each edge portion of the flap, the fabric ties for adjustably securing the flap to the side edges.

* * * * *